US010941530B2

(12) United States Patent
Calby

(10) Patent No.: US 10,941,530 B2
(45) Date of Patent: Mar. 9, 2021

(54) SELECTIVELY-CONFIGURABLE BARRICADE

(71) Applicant: AMERICAN LOUVER COMPANY, Des Plaines, IL (US)

(72) Inventor: Daniel Patrick Calby, Park Ridge, IL (US)

(73) Assignee: AMERICAN LOUVER COMPANY, Des Plaines, IL (US)

( * ) Notice: Subject to any disclaimer, the term of this patent is extended or adjusted under 35 U.S.C. 154(b) by 0 days.

(21) Appl. No.: 16/423,521

(22) Filed: May 28, 2019

(65) Prior Publication Data

US 2020/0018025 A1 Jan. 16, 2020

Related U.S. Application Data

(60) Provisional application No. 62/676,652, filed on May 25, 2018.

(51) Int. Cl.
*E01F 13/00* (2006.01)
*E01F 13/02* (2006.01)

(52) U.S. Cl.
CPC ..... *E01F 13/02* (2013.01)

(58) Field of Classification Search
CPC ..... E01F 13/02
USPC ..... 404/6; 256/13.1
See application file for complete search history.

(56) References Cited

U.S. PATENT DOCUMENTS

| | | | | |
|---|---|---|---|---|
| 6,190,084 | B1 * | 2/2001 | Ibanez | E01F 13/02 160/351 |
| 6,676,113 | B2 * | 1/2004 | Christensen | E01F 13/022 160/351 |
| 7,540,682 | B1 * | 6/2009 | Christensen | E01F 13/022 116/63 P |
| D599,488 | S * | 9/2009 | Christensen | E01F 13/00 D25/48.5 |
| 8,979,418 | B2 * | 3/2015 | Whiteley | E01F 13/022 404/35 |
| 9,624,630 | B1 * | 4/2017 | Maus | E04H 17/16 |
| 9,926,679 | B1 * | 3/2018 | Vila | E01F 13/022 |
| 2013/0287491 | A1 * | 10/2013 | Petryshyn | E01F 13/085 404/6 |
| 2019/0093296 | A1 * | 3/2019 | Whiteley | E01F 13/022 |

* cited by examiner

*Primary Examiner* — Raymond W Addie
(74) *Attorney, Agent, or Firm* — McDermott Will & Emery LLP

(57) ABSTRACT

Selectively-configurable barricade systems are provided. A barricade system includes a main body including an upper side, a lower side, a first lateral side and a second lateral side extending between the upper side and the lower side, a first surface and a second surface extending between the first lateral side and the second lateral side, and a channel extending from the lower side toward the upper side. The barricade system includes a leg post including a first end and a second end. The first end is slidably and rotatably disposed within the channel. The barricade system includes a first foot connected to the second end of the leg post. The barricade system includes a collar connected to the leg post disposed within the channel. The channel includes a collar aperture. The collar connected to the portion of the first leg post is disposed within the collar aperture of the channel.

18 Claims, 14 Drawing Sheets

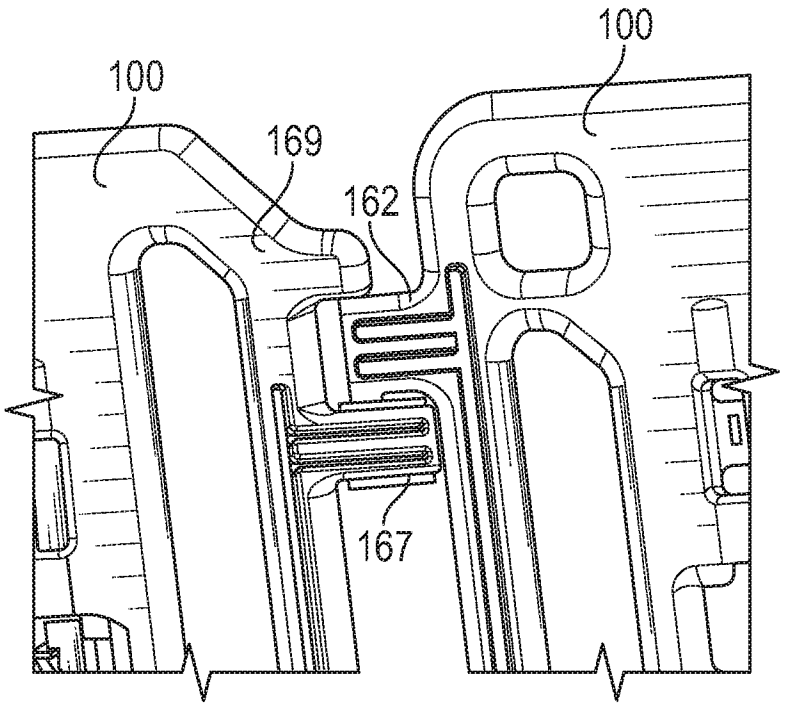
FIG. 7
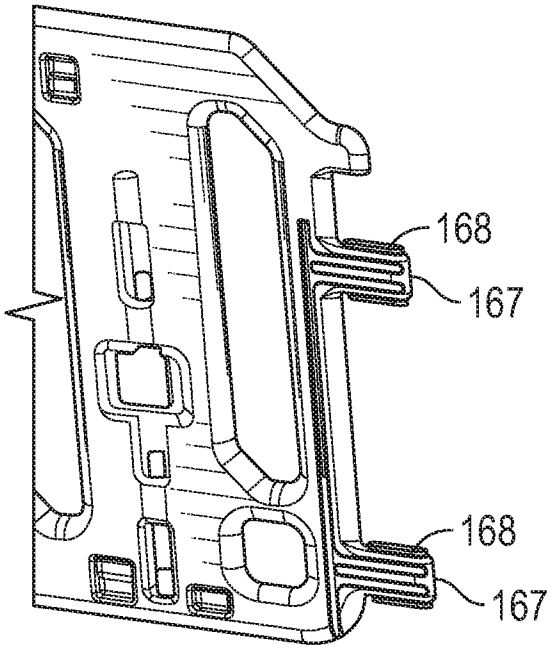

SELECTIVELY-CONFIGURABLE BARRICADE

CROSS-REFERENCE TO RELATED APPLICATIONS

This application claims the benefit of U.S. Provisional Application No. 62/676,652 filed on May 25, 2018, which is herein incorporated by reference in its entirety.

TECHNICAL FIELD

This disclosure relates to a barricade system having a locking and selectively-deployable support system.

BACKGROUND

Standard barricade systems are generally known in the art. However, such conventional barricades only have a single operational mode, have difficulty in the face of adverse weather conditions and prevent convenient stacking and transportation. Further, such conventional barricades do not offer selective locking in both deployed and stowed states.

Accordingly, there is an unmet need for an improved selectively-configurable barricade system. The present disclosure seeks to overcome some limitations and other drawbacks of the prior art, and to provide new features not heretofore available. A full discussion of the features and advantages of the present disclosure is deferred to the following detailed description, which proceeds with reference to the accompanying drawings.

SUMMARY

According to certain aspects of the present disclosure, a barricade system is provided. The barricade system includes a main body including an upper side, a lower side disposed opposite the upper side, a first lateral side extending between the upper side and the lower side, a second lateral side extending between the upper side and the lower side, the second lateral side disposed opposite the first lateral side, a first surface extending between the first lateral side and the second lateral side, a second surface extending between the first lateral side and the second lateral side, the second surface disposed opposite the first surface, and a channel extending from the lower side toward the upper side, the channel including an opening at the lower side. The barricade system also includes a first leg post including a first end and a second end opposite the first end. The first end slidably and rotatably disposed within the channel. The barricade system further includes a first foot rigidly connected to the second end of the first leg post. The barricade system also includes a collar rigidly connected to a portion of the first leg post disposed within the channel. The channel includes a collar aperture. The collar rigidly connected to the portion of the first leg post is disposed within the collar aperture of the channel.

According to certain aspects of the present disclosure, a barricade system is provided. The barricade system includes a main body including an upper side, a lower side disposed opposite the upper side, a first lateral side extending between the upper side and the lower side, a second lateral side extending between the upper side and the lower side, the second lateral side disposed opposite the first lateral side, a first surface extending between the first lateral side and the second lateral side, and a second surface extending between the first lateral side and the second lateral side. The second surface disposed opposite the first surface. The first lateral side comprises an engagement element. The second lateral side comprises an engagement element receptacle. When adjoining the barricade system to an adjacent barricade system, 1) the engagement element receptacle of the barricade system receives an engagement element of the adjacent barricade system or 2) an engagement element receptacle of the adjacent barricade system receives the engagement element of the barricade system.

According to certain aspects of the present disclosure, a barricade system is provided. The barricade system includes a main body including an upper side, a lower side disposed opposite the upper side, a first lateral side extending between the upper side and the lower side, a second lateral side extending between the upper side and the lower side, the second lateral side disposed opposite the first lateral side, a first surface extending between the first lateral side and the second lateral side, a second surface extending between the first lateral side and the second lateral side, the second surface disposed opposite the first surface, and a channel extending from the lower side toward the upper side, the channel including an opening at the lower side. The barricade system also includes a first leg post including a first end and a second end opposite the first end. The first end slidably and rotatably disposed within the channel. The barricade system further includes a first foot rigidly connected to the second end of the first leg post. The barricade system also includes a collar rigidly connected to a portion of the first leg post disposed within the channel. The first lateral side comprises an engagement element. The second lateral side comprises an engagement element receptacle. When adjoining the barricade system to an adjacent barricade system, 1) the engagement element receptacle of the barricade system receives an engagement element of the adjacent barricade system or 2) an engagement element receptacle of the adjacent barricade system receives the engagement element of the barricade system.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings:

FIG. 7 illustrates an example barricade system engagement according to certain aspects of the disclosure.

Figure 1A:
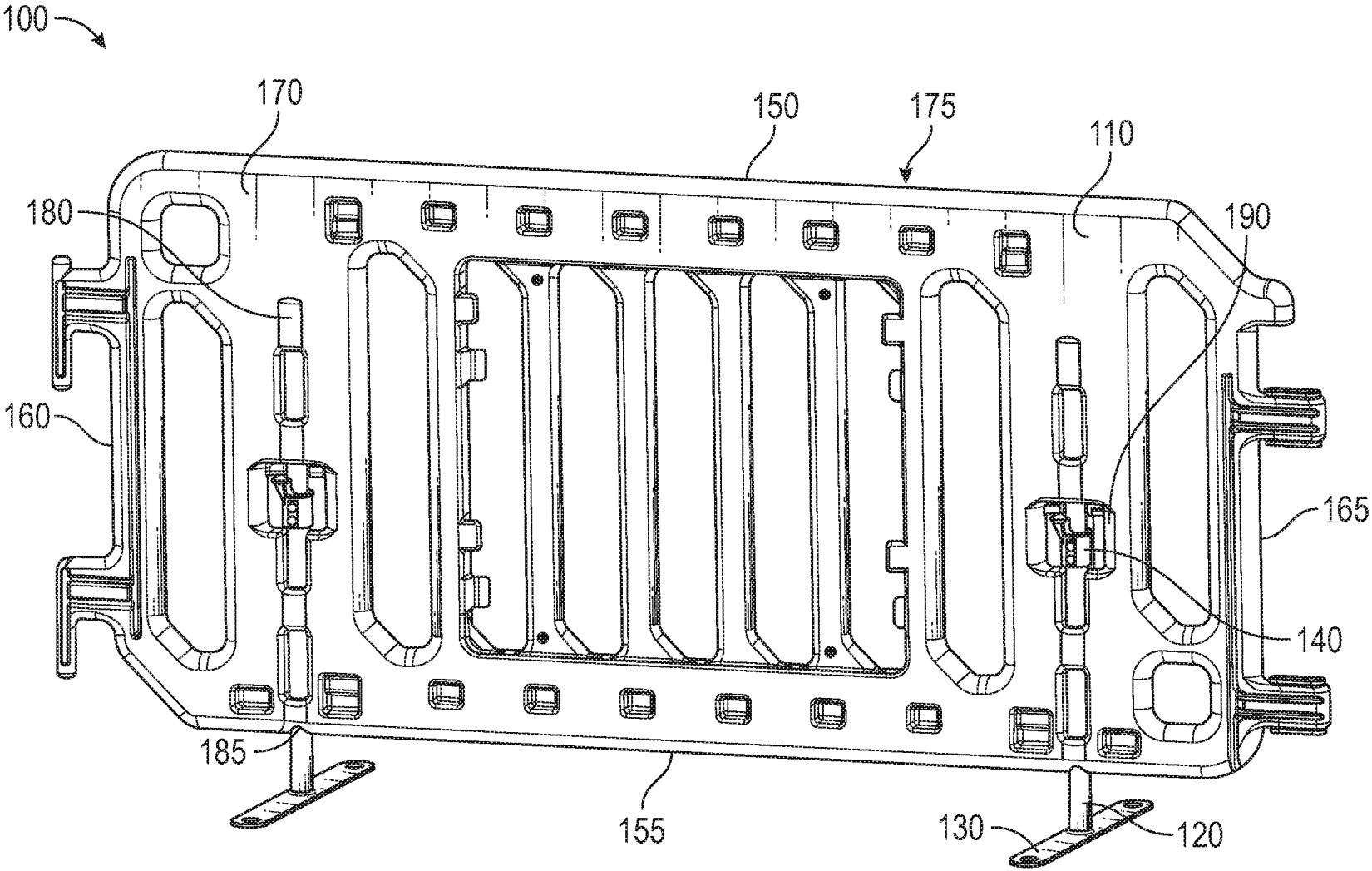
FIG. 1A illustrates an example barricade system 100 according to certain aspects of the disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

In addition, each of the drawings is a schematic diagram and thus is not necessarily strictly illustrated. In each of the drawings, substantially the same structural components are assigned with the same reference signs, and redundant descriptions will be omitted or simplified.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. For example, while the selectively-configurable barricade systems discussed herein may be implemented in many different forms, the disclosure will show in the drawings, and will herein describe in detail, implementations with the understanding that the present description is to be considered as an exemplification of the principles of the selectively-configurable barricade system and is not intended to limit the broad aspects of the disclosure to the implementations illustrated. Accordingly, the drawings and description are to be regarded as illustrative in nature and not restrictive.

Example System Architecture

FIG. 1A illustrates an example barricade system 100 according to certain aspects of the disclosure. The barricade system 100 includes a main body 110, leg posts 120, feet 130, and collars 140. FIG. 1A illustrates two leg posts, two feet, and two collars provided on the main body 110, but the number of each type of the elements is not limited to two, and may be less or more than the numbers of the elements shown in FIG. 1A. It is understood the dimensions of these elements are exemplary only, and other sizes and shapes are possible.

The main body 110 may include an upper side 150, a lower side 155, a first lateral side 160, a second lateral side 165, a first surface 170, a second surface 175, and a channel 180. For example, the main body 110 may be formed or blow-molded from high-density polyethylene.

The upper side 150 is disposed opposite the lower side 155. The first lateral side 160 extends between the upper side 150 and lower side 155. The second lateral side 165 extends between the upper side 150 and the lower side 155. The second lateral side 165 is disposed opposite the first lateral side 160. The first surface 170 extending between the first lateral side 160 and the second lateral side 165. The second surface 175 extending between the first lateral side 160 and the second lateral side 165. The second surface 175 is disposed opposite the first surface 170. The channel 180 includes an opening 185 at the lower side 155 and extends from the lower side 155 toward the upper side 150.

Figure 1B:
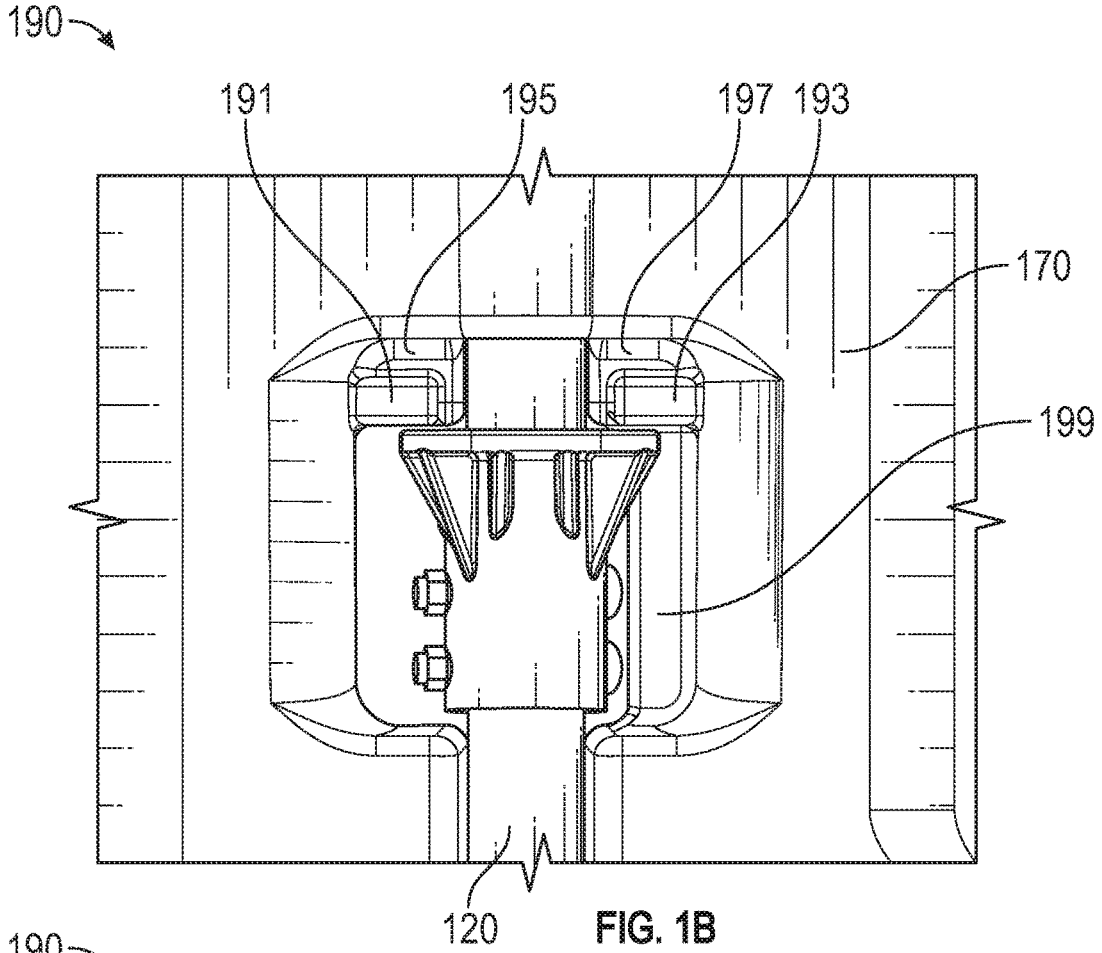
FIGS. 1B and 1C illustrate an example collar aperture 190 according to certain aspects of the disclosure.

The channel 180 includes a collar aperture 190. FIG. 1B illustrates an example collar aperture 190 according to certain aspects of the disclosure. The collar aperture 190 is a through-hole that extends from the first surface 170 to the second surface 175 of the main body 110. The collar aperture 190 includes stowed protrusions 191 and 193 that extend inward from an upper perimeter of the collar aperture 190 for a predetermined distance.

The collar aperture 190 also includes stowed detents 195 and 197. The stowed detent 195 is disposed between the stowed protrusion 191 and the upper perimeter of the collar aperture 190. Likewise, the stowed detent 197 is disposed between the stowed protrusion 193 and the upper perimeter of the collar aperture 190. The set of stowed protrusion 191 and stowed detent 195 are spaced apart from the set of stowed protrusion 193 and stowed detent 197 to accommodate the leg post 120 therebetween.

Figure 1C:
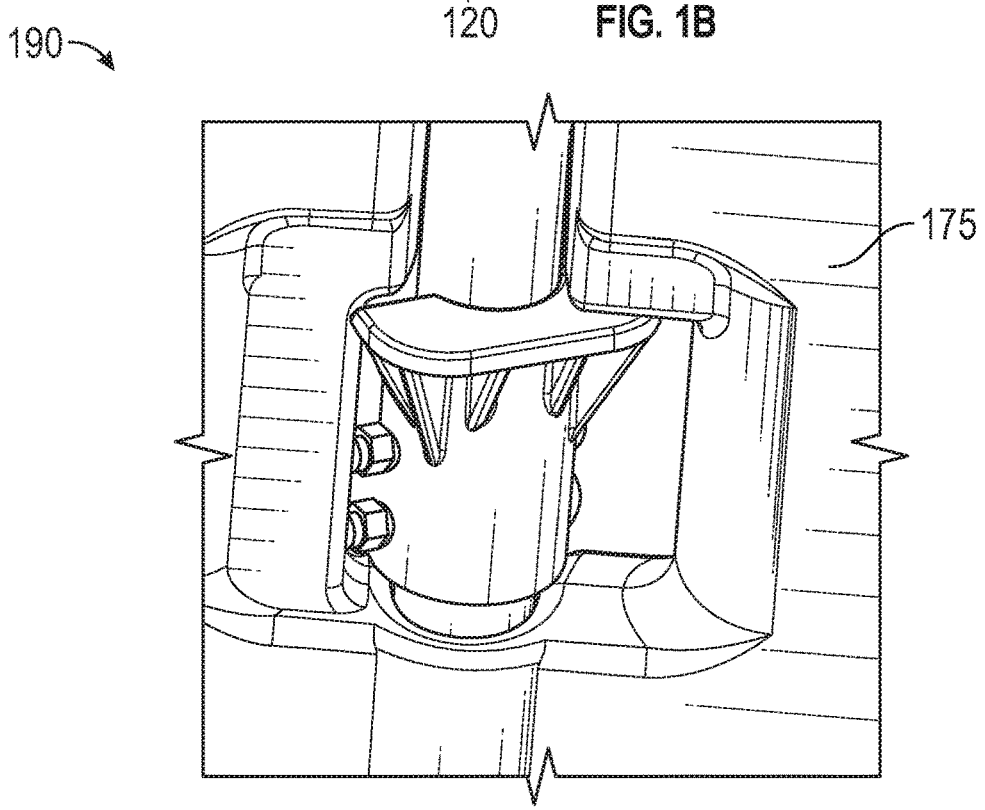

The collar aperture 190 includes a wall 199 extending from the lower portion of the stowed protrusion 191 to a lower perimeter of the collar aperture 190 to partially block the through-hole of the collar aperture 190. In some implementations, the stowed protrusions 191 and 193, the stowed detents 195 and 197, and the wall 199 of the collar aperture 190 are disposed on the first surface 170 of the main body 110. The surfaces of the stowed protrusions 191 and 193, the stowed detents 195 and 197, and the wall 199 of the collar aperture 190 on the second surface 175 side are even with each other as illustrated in FIG. 1C.

Figure 1E:
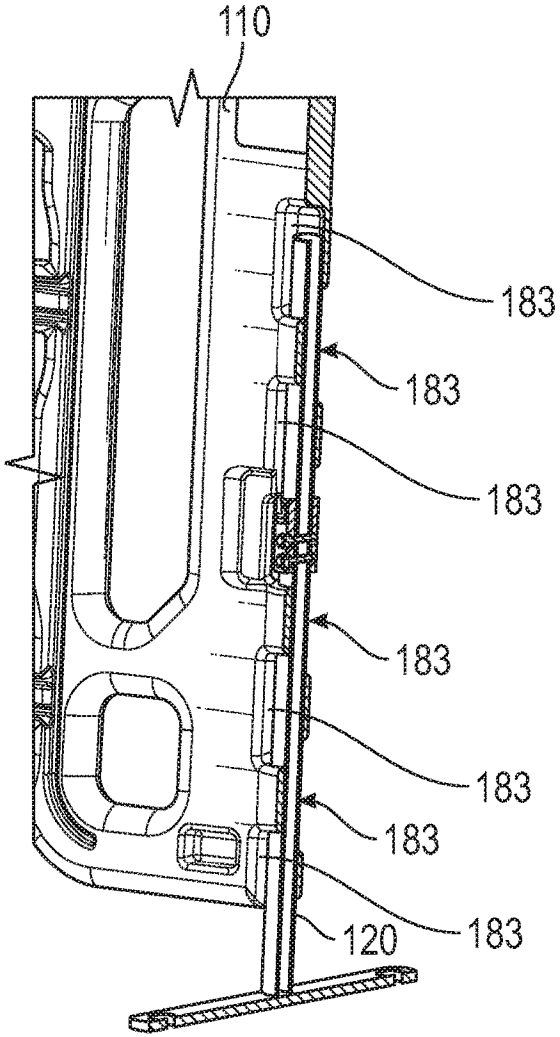
FIG. 1E illustrates a cross-sectional view of the channel 180 according to certain aspects of the disclosure.
Figure 1D:
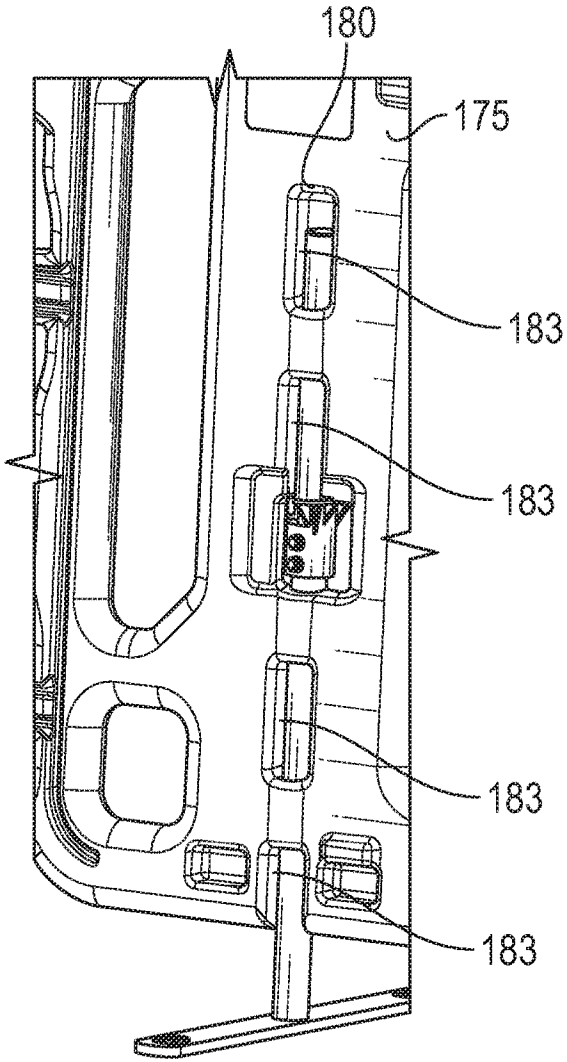
FIG. 1D illustrates an example channel 180 according to certain aspects of the disclosure.

FIG. 1D illustrates an example channel 180 according to certain aspects of the disclosure. The channel 180 includes side apertures 183. A first set of side apertures 183 is disposed on the first surface 170 of the main body 110, and a second set of side apertures 183 is disposed on the second surface 175 of the main body 110.

In some embodiments, the first set of side apertures 183 and the second set of side apertures 183 are alternately disposed so that the first set of side apertures 183 and the second set of side apertures 183 do not align with each other as shown in FIG. 1E illustrating a cross-sectional view of the channel 180 according to certain aspects of the disclosure. By alternating the side apertures 183, the retaining loads are distributed across the entire molded main body 110 enhancing the retention strength on the leg post 120.

Figure 2:
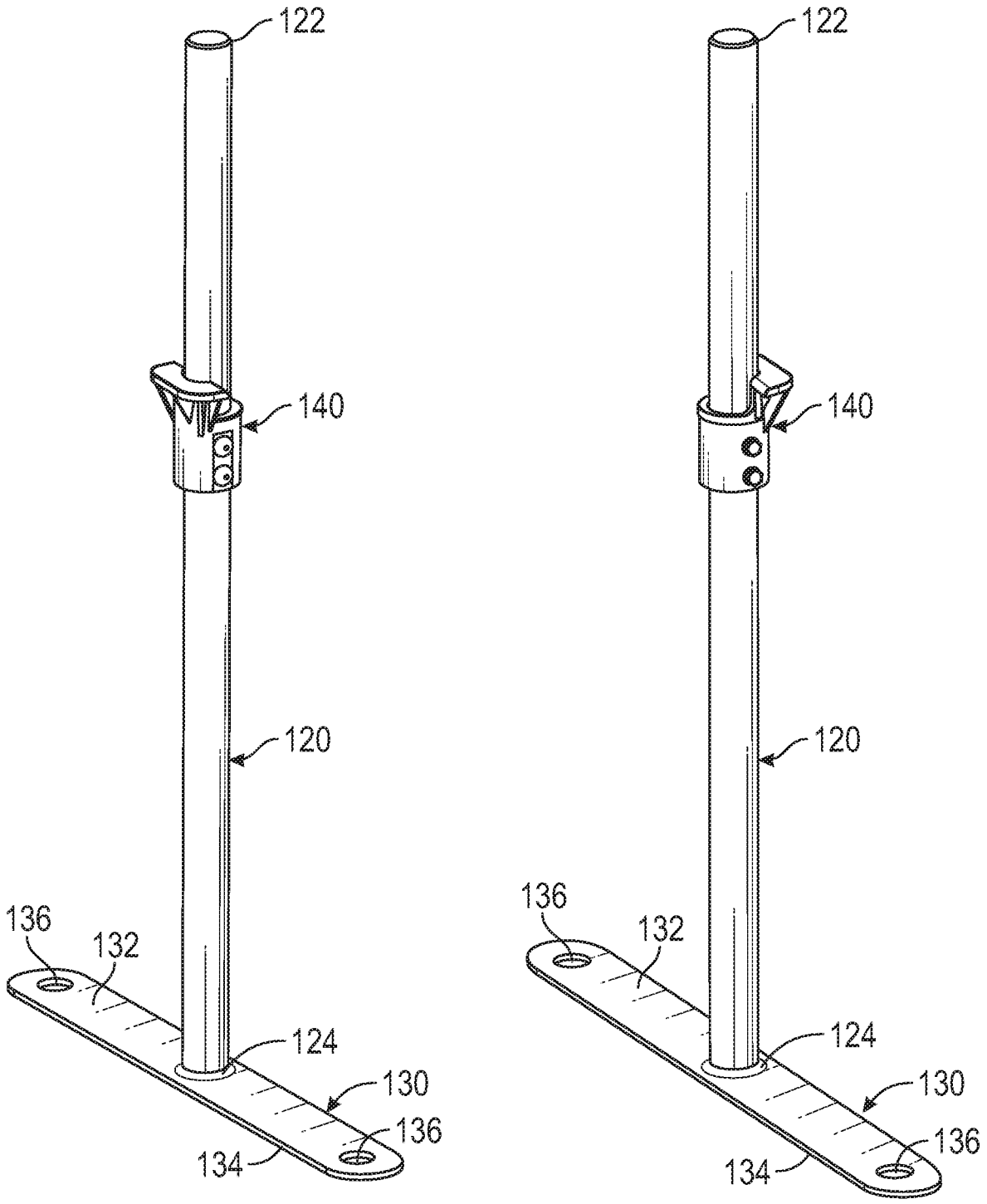
FIG. 2 illustrates an example assembly of leg posts 120, feet 130, and collars 140 according to certain aspects of the disclosure.

FIG. 2 illustrates an example assembly of leg posts 120, feet 130, and collars 140 according to certain aspects of the disclosure. The leg post 120 may be a cylindrical post. The leg post 120 is not limited to a cylindrical post as illustrated in FIG. 2, but may be in any shape. The leg post 120 includes a first end 122 and a second end 124 opposite the first end 122. The first end 122 is slidably and rotatably disposed within the channel 180 of the main body 110 as shown in FIG. 1A. The second end 124 is rigidly connected to the foot 130. The leg posts 120 each includes the collar 140 rigidly connected to a portion of the leg post 120 disposed within the channel 180 as shown in FIG. 1A.

The foot 130 may be an elongated shaped plate having a first surface 132 and a second surface 134 opposite the first surface 132. The second end 124 of the leg post 120 may be rigidly connected to the first surface 132 of the foot 130. In some instances, the leg post 120 is connected to the foot 130 so that the leg post 120 and the foot 130 are perpendicular to each other. The second surface 134 may be in contact with a ground surface when the barricade system is in a deployed state. In some instances, the foot 130 includes a through-hole 136 at each end of the elongated shaped plate. In some instances, grommets (not shown) may be disposed in the through-holes 136. The grommets (not shown) may be made of a rubber material to provide a more stable and quiet interface between the foot 130 and the ground surface when the barricade system 100 is in a deployed state.

The collar 140 is rigidly connected to the portion of the leg post 120 that is disposed within the collar aperture 190 of the channel 180. In some implementations, the collar 140 is at least partially disposed within the collar aperture 190, such that the collar 140 can slide and rotate within the collar aperture 190 along with the rotation of the leg post 120.

Figure 3B:
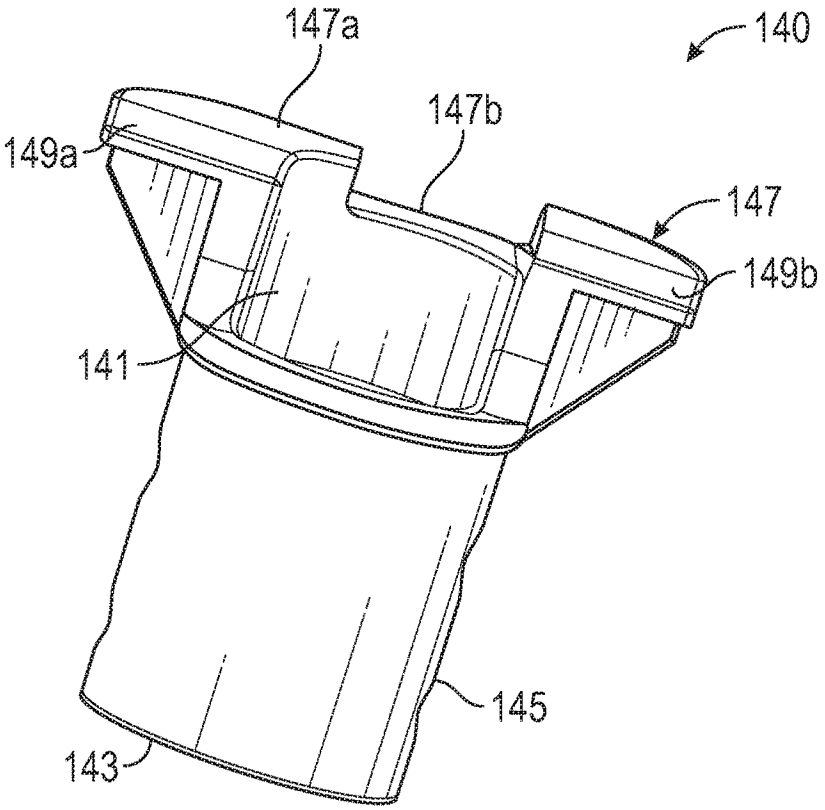
FIGS. 3A and 3B illustrate an example collar 140 according to certain aspects of the disclosure.
Figure 3A:
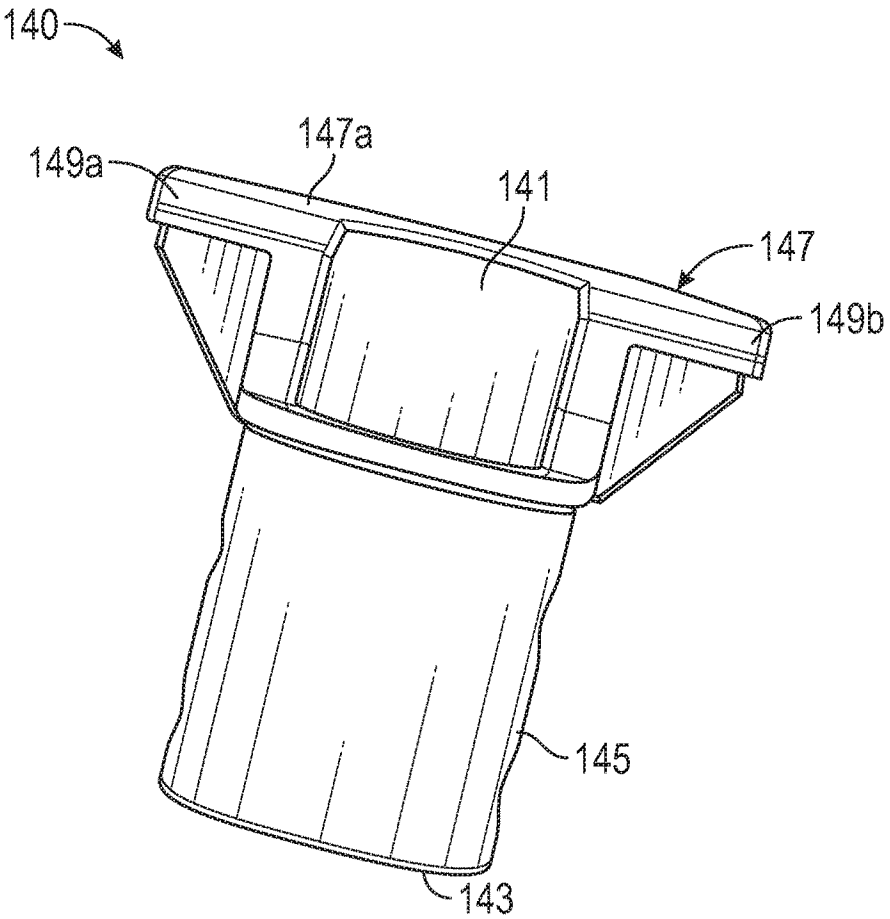

FIG. 3 illustrates an example collar 140 according to certain aspects of the disclosure. The collar 140 includes a first collar opening 141 and a second collar opening 143 disposed opposite the first collar opening 141. The collar 140 includes a hollow cylindrical portion 145 extending between the first collar opening 141 and the second collar opening 143. The hollow cylindrical portion 145 receives the leg post 120 therethrough. The first collar opening 141 includes a rim 147 that extends radially outward from the first collar opening 141. The rim 147 includes a circumferential gap between a first rim end 149*a* and a second rim end 149*b*. In some implementations, the first rim end 149*a* and the second rim end 149*b* are spaced apart from each other at an angle of 180 degrees.

The rim 147 has a flat surface 147*a* that is arranged perpendicular to the hollow cylindrical portion 145 as shown in FIG. 3(*a*). In some implementations, the flat surface 147*a* of the rim 147 may have a collar indent 147*b* as shown in FIG. 3(*b*).

Figure 4A:
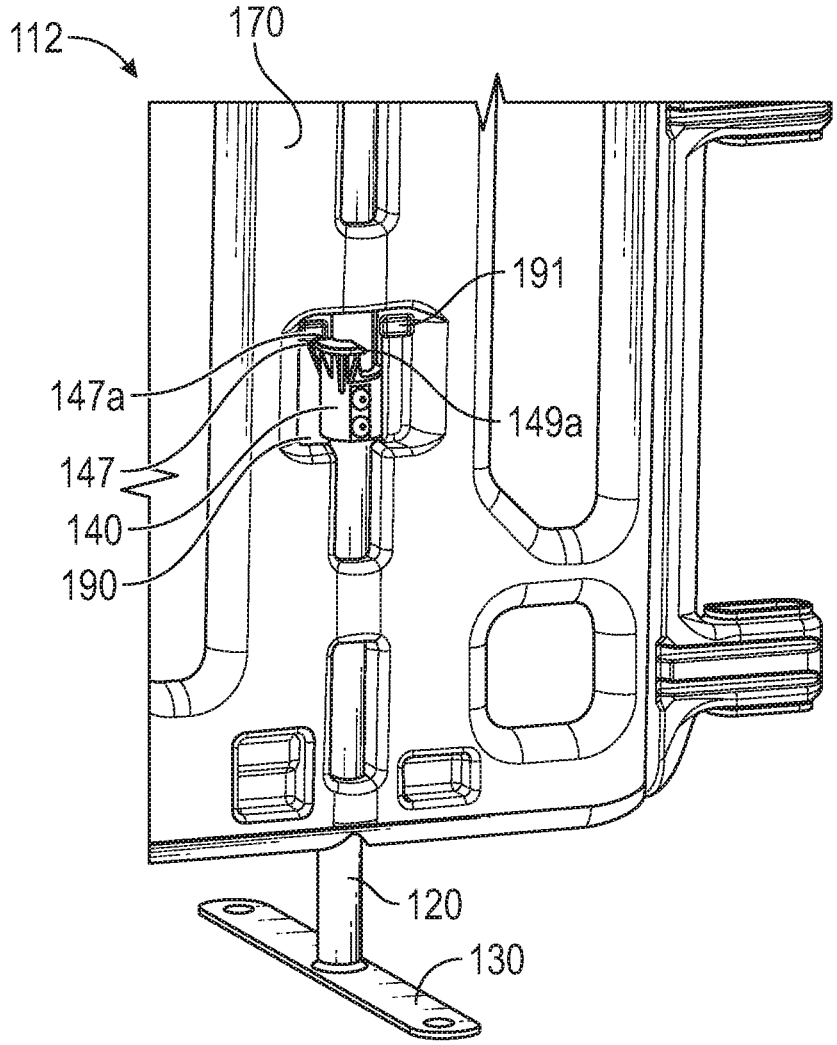
FIG. 4A illustrates an example barricade system 100 in a deployed state 112 according to certain aspects of the disclosure.
Figure 4B:
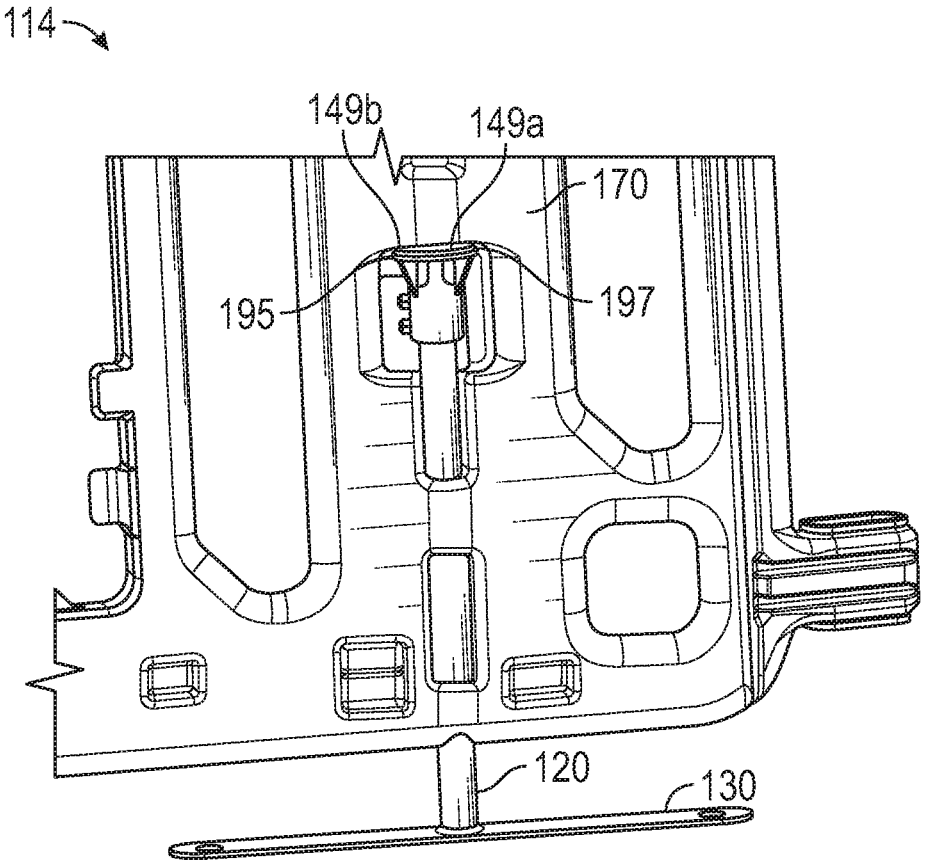
FIG. 4B illustrates an example barricade system 100 in a stowed state 114 according to certain aspects of the disclosure.

FIG. 4A illustrates an example barricade system 100 in a deployed state 112 according to certain aspects of the disclosure. FIG. 4B illustrates an example barricade system 100 in a stowed state 114 according to certain aspects of the disclosure. The barricade system 100 can be disposed in the deployed state 112, the stowed state 114, or a transitional state therebetween.

Referring to FIG. 4A, when the barricade system 100 is in the deployed state 112, the leg post 120, the foot 130, and the collar 140 are releasably locked in a deployed configuration. In the deployed state 112, the leg post 120 is rotated so that the foot 130, the first rim end 149*a*, and the second rim end 149*b* are substantially perpendicular with the first surface 170 and the second surface 175 of the main body 110. In the deployed state 112, the flat surface 147*a* of the rim 147 of the collar 140 abuts the lower portion of the stowed protrusion 191 of the collar aperture 190.

Figure 5:
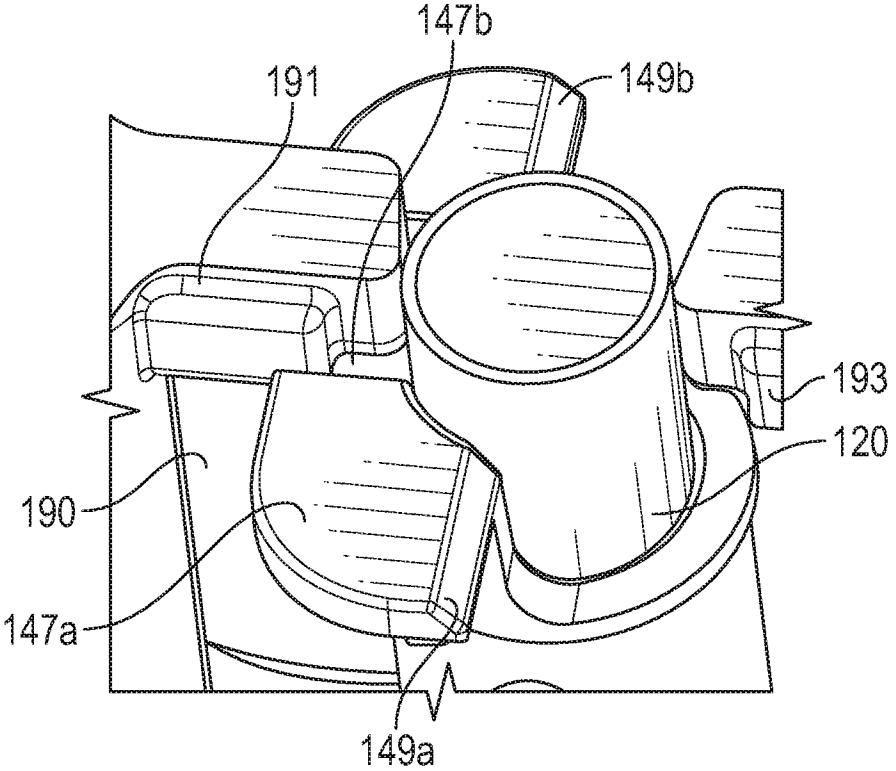
FIG. 5 illustrates an example collar incident 147*b* according to certain aspects of the disclosure.

In some implementations, the collar indent 147*b* of the rim of the collar 140 engages with the stowed protrusion 191 accommodating the stowed protrusion 191 within the collar incident 147*b* to prevent the leg post 120 from rotating while the barricade system 100 is in the deployed state 112 as shown in FIG. 5 that illustrates an example collar incident 147*b* according to certain aspects of the disclosure. This provides a releasably locked engagement between the collar indent 147*b* and the deployed protrusion 191.

In case when the rim 147 does not include the collar indent 147*b* and when the leg post 120 rotates further while in the deployed state 112, the second rim end 149*b* abuts the wall 199 of the collar aperture 190 on the second surface 175 side preventing the leg post 120 to rotate further and keeping the flat surface 147*a* of the rim 147 in contact with the lower portion of the stowed protrusion 191.

Such arrangements serve to prevent the collar 140 (and thus the connected leg post 120 and foot 130) from relatively rotating about or translating (in an upward direction, or a direction bringing the foot 130 closer to the main body 110) along a longitudinal axis of the leg post 120 in the deployed state 112.

Referring to FIG. 4B, when the barricade system 100 is in the stowed state 114, the leg post 120, the foot 130, and the collar 140 are releasably locked in a stowed configuration. In the stowed state 114, the leg post 120 is rotated so that the foot 130, the first rim end 149*a*, and the second rim end 149*b* are substantially parallel with the first surface 170 and the second surface 175 of the main body 110. In the stowed state 114, the first rim end 149*a* and the second rim end 149*b* act as a collar locking protrusion 149*c*. The collar locking protrusion 149*c* is engaged, or releasably engaged, with the stowed detents 195 and 197 on the main body 110.

Further, in the stowed state 114, the collar locking protrusion 149*c* and/or the stowed detents 195 and 197 are arranged perpendicular to a longitudinal axis of the leg post 120, and substantially parallel with the foot 130. Such an arrangement provides a releasably locked engagement between the stowed detents 195 and 197 and the collar locking protrusion 149*c*, and thus between the main body 110 and the collar 140, leg post 120, and foot 130, that serves to prevent the collar 140 (and thus the attached leg post 120 and foot 130) from relatively rotating about or translating along a longitudinal axis of the leg post 120 in the stowed state 114.

In operation, from the deployed state 112 or a transitional state between the deployed state 112 and the stowed state 114, the barricade system 100 can transition into the stowed state 114. Initially, if not already positioned as such, the collar 140 (and thus the connected leg post 120 and foot 130) can be rotated such that the collar locking protrusion 149*c* is disposed on the same side (e.g., the first surface 170) of the main body 110 as the stowed detents 195 and 197 and the stowed protrusion 191. The collar 140, leg post 120 and foot 130 can then be translated upwardly, or in a direction causing the foot 130 to be brought closer to the main body 110, such that the collar locking protrusion 149*c* (i.e., first rim end 147*a* and second rim end 147*b*) contacts the stowed protrusion 191.

With a threshold degree of translational force applied to one or more of the leg post 120 and/or the collar 140, and the main body 110, the collar locking protrusion 149*c* and/or the stowed protrusion 191 deflects and/or deforms such that the collar locking protrusion 149*c* can translate past the stowed protrusion 191 and releasably engage with the stowed detents 195 and 197. As described above, this releasable engagement between the collar locking protrusion 149*c* and the stowed detents 195 and 197 prevents the collar 140 (and thus the connected leg post 120 and foot 130) from relatively rotating about or translating along a longitudinal axis of the leg post 120 in the stowed state 114.

In operation, from the deployed state 112 or a transitional state between the deployed state 112 and the stowed state 114, the barricade system 100 can transition into the deployed state 112. Initially, if not already positioned as such, the collar locking protrusion 149*c* can be disengaged from the stowed detents 195 and 197 using a disengagement threshold degree of force longitudinally on the leg post 120, foot 130 or collar 140 in the opposite direction as described in the immediately preceding paragraph. The collar 140 (and thus the connected leg post 120 and foot 130) can then be rotated such that the collar indent 147*b* is disposed proximate, and immediately below, the stowed protrusion 191. The collar 140, leg post 120 and foot 130 can then be translated upwardly, or in a direction causing the foot 130 to be brought closer to the main body 110, such that the stowed protrusion 191 is disposed within the collar indent 147*b*. This releasable engagement between the stowed protrusion 191 and the collar indent 147*b* prevents the collar 140 (and thus the attached leg post 120 and foot 130) from relatively rotating about or translating (in an upward direction, or a direction bringing the foot 130 closer to the main body 110) along a longitudinal axis of the leg post 120 in the stowed state 114. The force of gravity serves to press the main body 110, and thus the stowed protrusion 191, down on the collar indent 147*b* to maintain the deployed state 112.

In addition, the releasable engagements in the deployed state 112 and the stowed state 114, in place of or in addition to the above-described features, include interference fits, clips, snaps, buckles, hooks, adhesives, magnets, hook-and-loop panels, brackets, rotational locking fits or any other physical and/or chemical attachment system known to those skilled in the art to releasably lock the collar 140 and main body 110 in the stowed state 114 and the deployed state 112. It is also to be understood that any of the above-described features can be integrally formed, or separate from, any other above-described feature in this disclosure.

Figure 6:
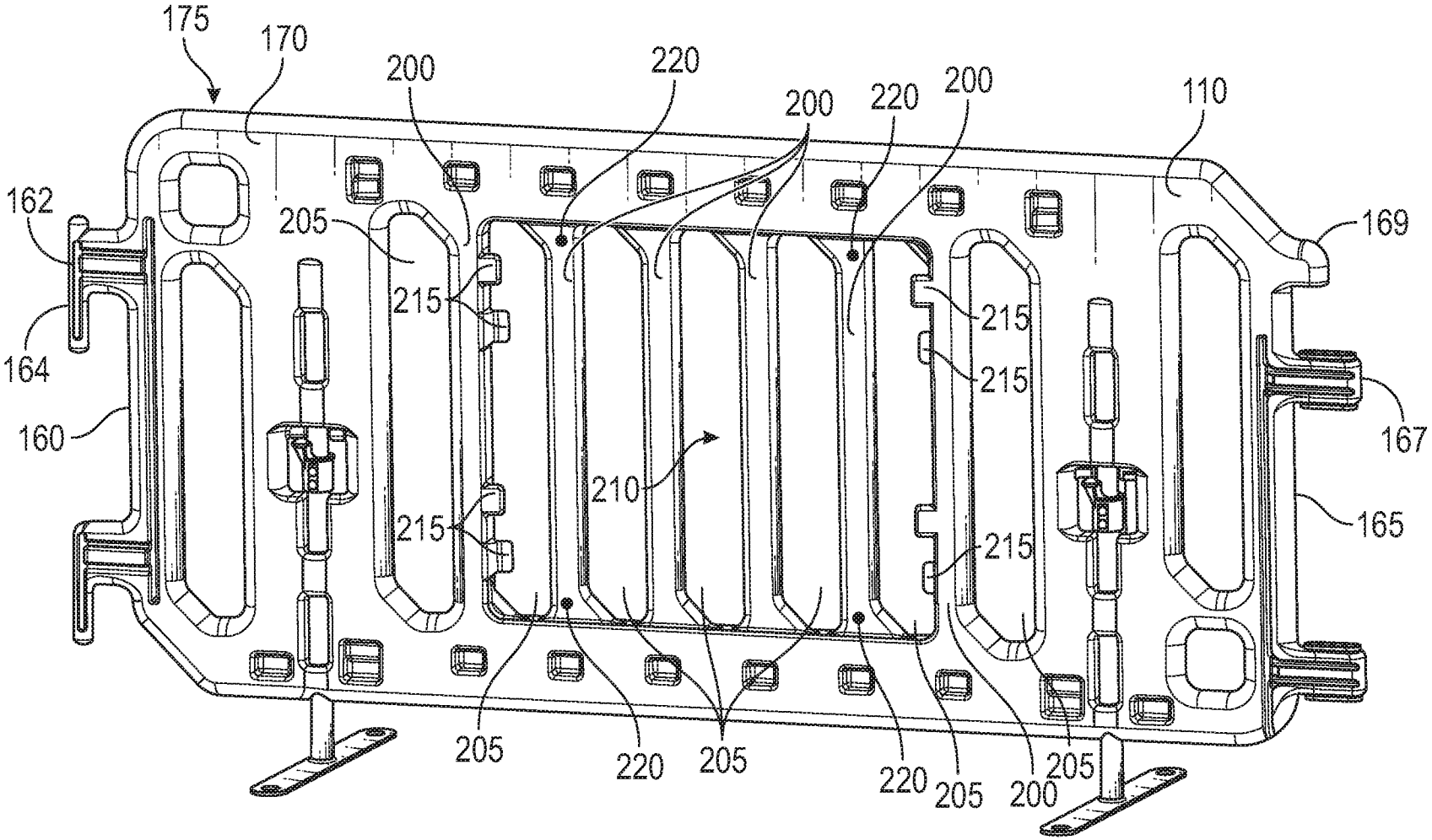
FIG. 6 illustrates an example barricade system 100 according to certain aspects of the disclosure.

FIG. 6 illustrates an example barricade system 100 according to certain aspects of the disclosure. The first lateral side 160 of the main body 110 includes an engagement element 162 and a pin 164 that extends downward from a lower portion of the engagement element 162. The second lateral side 165 of the main body 110 includes an engagement element receptacle 167 and a boss portion 169. The boss portion 169 is disposed closer to the upper side 150 of the main body 110 than the engagement element receptacle 167.

Referring to FIG. 7 that illustrates an example barricade system engagement according to certain aspects of the disclosure, the engagement element receptacle 167 includes a receptacle port 168. When a first barricade system 100 engages a second barricade system 100, the engagement element 162 of the first barricade system 100 engages with the engagement element receptacle 167 of the second barricade system 100. In operation, when a first barricade system 100 engages a second barricade system 100, the pin 164 (not shown) of the engagement element 162 of the first barricade system 100 is inserted in the receptacle port 168 of the engagement element receptacle 167 of the second barricade system 100. The engagement element 162 of the first barricade system 100 is sandwiched between the engagement element receptacle 167 and the boss portion 169 of the second barricade system 100.

The engagement element receptacle 167 extends further out from the second lateral side 165 of the barricade system 100 than the boss portion 169. The boss portion 169 prevents the first barricade system 100 from being disengaged from the second barricade system 100 without first sliding the first barricade system 100 away from the second barricade system 100 so that the engagement element 162 of the first barricade system 100 is no longer sandwiched between the engagement element receptacle 167 and the boss portion 169 of the second barricade system 100.

Referring back to FIG. 6, the main body 110 includes a plurality of vertical members 200 and main body apertures 205 disposed therebetween. The main body apertures 205 are through-holes extending from the first surface 170 and the second surface 175 of the main body 110. The main body 110 further includes a sign recess portion 210 on the first surface 170 of the main body. The sign recess portion 210 extends over a number of vertical members 200 and a number of main body apertures 205. The sign recess portion 210 releasably secures signage on the first surface 170 of the main body 110 of the barricade system 100. Stay tabs 215 are disposed on the perimeter of the sign recess portion 210 to secure the signage on the barricade system 100. In some implementation, bolt holes 220 are disposed on the number of vertical members 200 to secure the signage on the barricade system 100.

Figure 8:
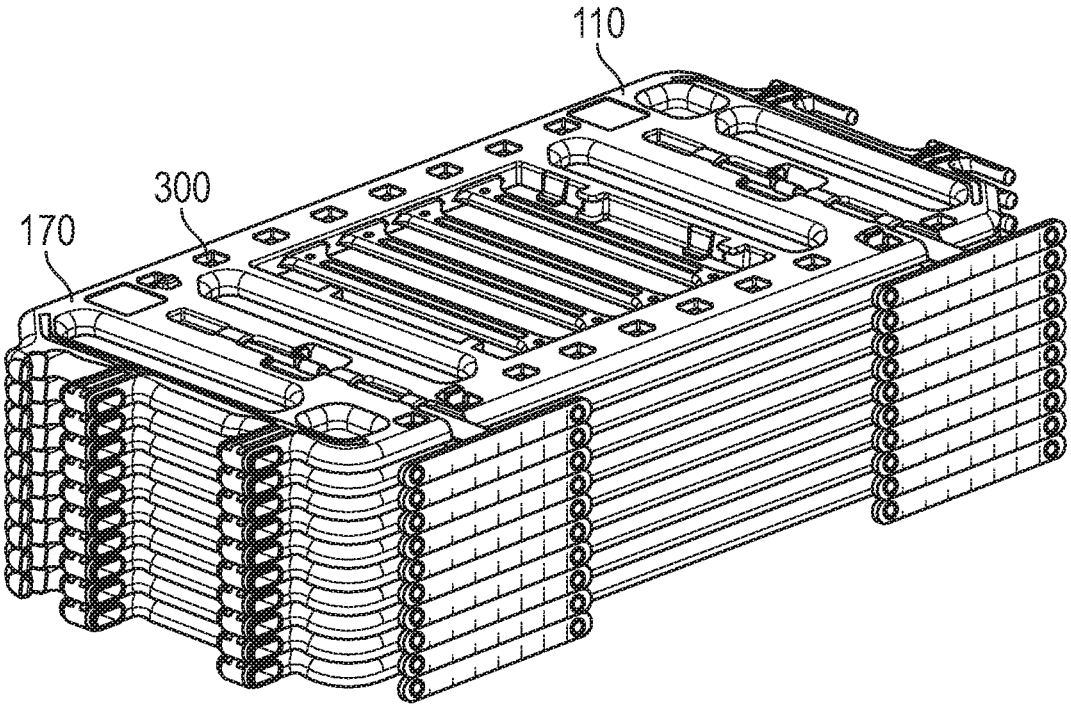
FIG. 8 illustrates an example storage configuration of barricade system 100 according to certain aspects of the disclosure.

FIG. 8 illustrates an example storage configuration of barricade system 100 according to certain aspects of the disclosure. The main body 110 includes stacking cavities 300 on the first surface 170 of the main body 110 and stacking protrusions 305 (not shown) on the second surface 175 (not shown) of the main body 110. As will be described below in further detail, multiple barricade systems 100 can be horizontally stacked when the barricade systems 100 are in a stowed state. Further, when a first barricade system 100 and a second barricade system 100 are horizontally stacked, the stacking protrusions 305 on the first surface 170 of the first barricade system 100 can be disposed at least partially within the stacking cavities 300 on the second surface 175 of the second barricade system 100 to facilitate secure and stable stacking of the barricade systems 100. The stacking cavities 300, while not shown, are cavities sized similarly to the stacking protrusions 305 and positioned on corresponding second surface 175 locations as the first surface 170 locations occupied by the stacking protrusions 305.

Figure 9B:
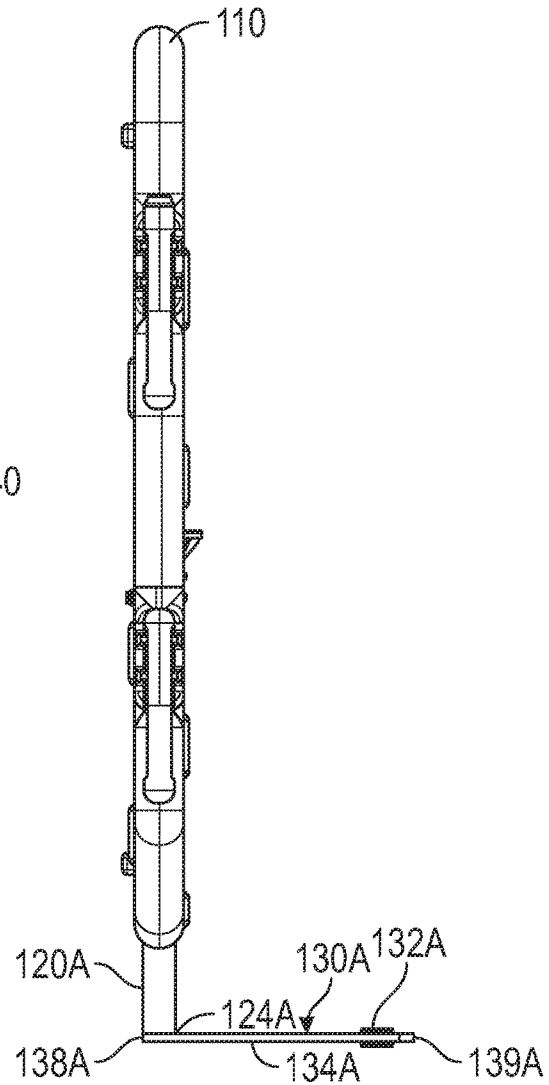
FIGS. 9A and 9B illustrate an example barricade system 100 according to certain aspects of the disclosure.
Figure 9A:
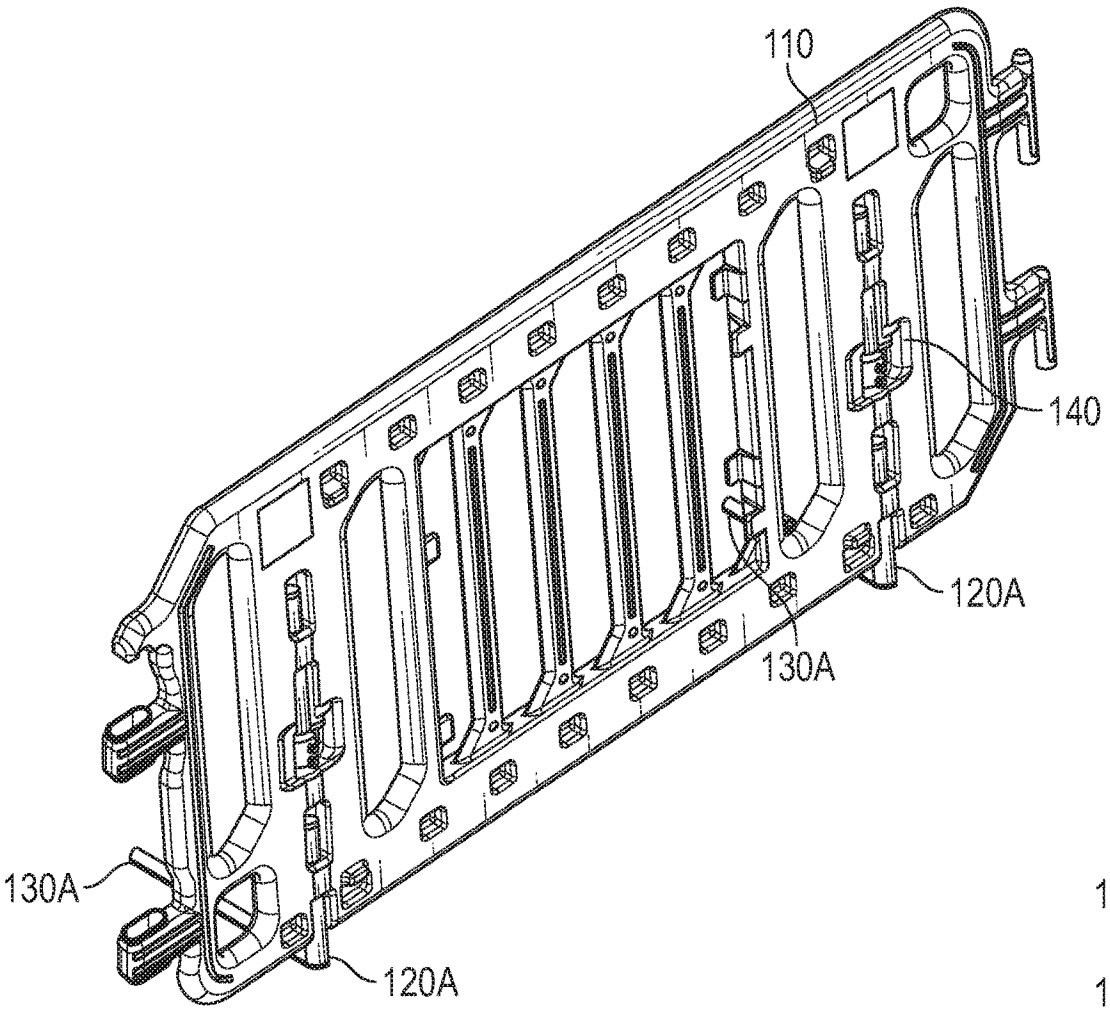

FIG. 9A illustrates an example barricade system 100 according to certain aspects of the disclosure. The barricade system 100 includes a main body 110, leg posts 120A, feet 130A, and collars 140. FIG. 9B illustrates a side view of an example barricade system 100 according to certain aspects of the disclosure. Since the structures of the main body 110 and the collars 140 are similar to those described in FIG. 1A, the descriptions are omitted for the sake of simplicity.

The structure of the leg post 120A is similar to that of the leg post 120 described in FIG. 2. In addition, similarly to the leg post 120 described in FIG. 2, the leg post 120A includes a second end 124A. The second end 124A of the leg post 120A is rigidly connected to the foot 130A.

The foot 130A may be an elongated shaped plate that includes a first surface 132A and a second surface 134A opposite the first surface 132A. The elongated shaped plate of the foot 130A may include a first end 138A and a second end 139A. The second end 124A of the leg post 120A may be rigidly connected to the first end 138A on the first surface 132A of the foot 130A. In some instances, the leg post 120A is connected to the foot 130A so that the leg post 120A and the foot 130A are perpendicular to each other. The second surface 134A may be in contact with a ground surface when the barricade system is in a deployed state. When the barricade system 100 is in a deployed state, the foot 130A extends out on one side of the barricade system 100. This structure of having the foot 130A extend only on one side of the barricade system 100 allows clearance on the other side of the barricade system 100 preventing any potential trip hazards.

Figure 10:
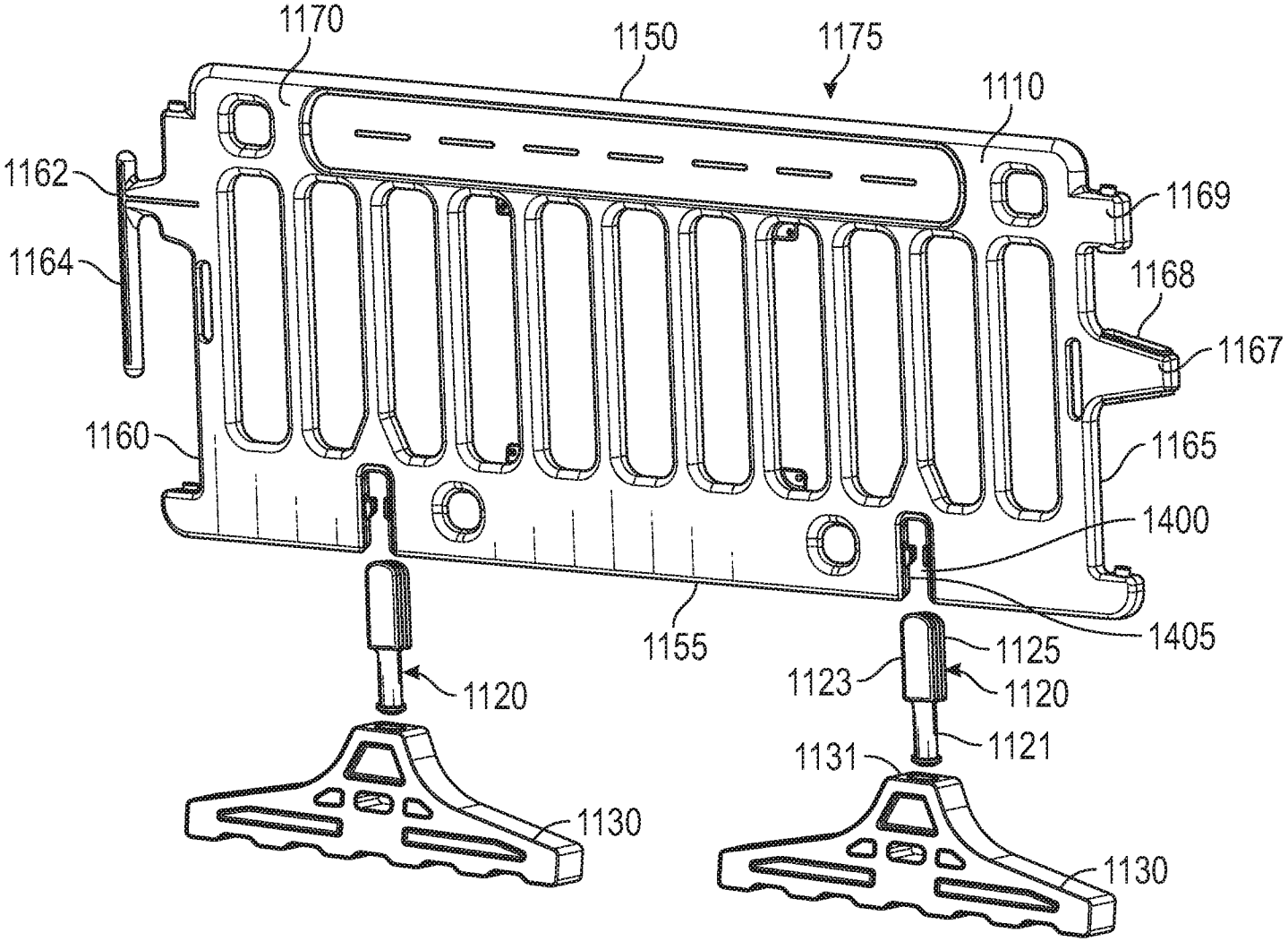
FIG. 10 illustrates an example barricade system 1100 according to certain aspects of the disclosure.

FIG. 10 illustrates an example barricade system 1100 according to certain aspects of the disclosure. The barricade system 1100 includes a main body 1110, leg posts 1120, feet 1130, and collars 140. The main body 1110 may include an upper side 1150, a lower side 1155, a first lateral side 1160, a second lateral side 1165, a first surface 1170, a second surface 1175, and a slit 1400.

The upper side 1150 is disposed opposite the lower side 1155. The first lateral side 1160 extends between the upper side 1150 and lower side 1155. The second lateral side 1165 extends between the upper side 1150 and the lower side 1155. The second lateral side 1165 is disposed opposite the first lateral side 1160. The first surface 1170 extending between the first lateral side 1160 and the second lateral side 1165. The second surface 1175 extending between the first lateral side 1160 and the second lateral side 1165. The second surface 1175 is disposed opposite the first surface 1170. The slit 1400 extends from the lower side 155 toward the upper side 150. The slit 1400 includes a protrusion member 1405 that extends along the perimeter of the slit 1400.

The first lateral side 1160 includes an engagement element 1162 and a pin 1164 that extends downward from a lower portion of the engagement element 1162. The second lateral side 1165 includes an engagement element receptacle 1167 and a boss portion 1169. The boss portion 1169 is disposed closer to the upper side 1150 of the main body 1110 than the engagement element receptacle 1167. The engagement element receptacle 1167 includes a receptacle port 1168.

When a first barricade system 1100 engages a second barricade system 1100, the engagement element 1162 of the first barricade system 1100 engages with the engagement element receptacle 1167 of the second barricade system 1100. In operation, when a first barricade system 1100 engages a second barricade system 1100, the pin 1164 of the engagement element 1162 of the first barricade system 1100 is inserted in the receptacle port 1168 of the engagement element receptacle 1167 of the second barricade system 1100. The engagement element 1162 of the first barricade system 1100 is sandwiched between the engagement element receptacle 1167 and the boss portion 1169 of the second barricade system 100.

The engagement element receptacle 1167 extends further out from the second lateral side 1165 than the boss portion 1169. The boss portion 1169 prevents the first barricade system 1100 from being disengaged from the second barricade system 1100 without first sliding the first barricade system 1100 away from the second barricade system 1100 so that the engagement element 1162 of the first barricade system 1100 is no longer sandwiched between the engagement element receptacle 1167 and the boss portion 1169 of the second barricade system 1100.

The leg post 1120 includes a base 1121 and a bracket 1123. The base 1121 may be a cylindrical post. In some embodiments, the base 1121 is not limited to a cylindrical post, but may be in any other shapes. The bracket 1123 is connected to a first end of the base 1121. The bracket 1123 includes a groove 1125. In operation, the bracket 1123 of the leg post 1120 slides into the slit 1400 of the main body 1110 so that the groove 1125 of the bracket 1123 engages the protrusion member 1405 of the slit 1400 to securely attach the leg post 1120 and the main body 1110.

The foot 1130 includes a port 1131. The foot 1130 may be in an elongated shape. The port 1131 may be disposed substantially in the mid-point of the longitudinal direction of the elongated shape. An upper surface of the foot 1130 may be tapered toward the port 1131. A lower surface of the 1130 may be in contact with a ground surface when the barricade system 1100 is in a deployed state. In operation, the port 1131 engages with the base 1121 of the leg post 1120 so that the leg post 1120 is connected to the foot 1130 allowing the barricade system 1100 to be in a deployed state. The foot 1130 is rotatable between a deployed state and a stowed state. Ideally, when the barricade system 1100 is in the deployed state, the foot 1130 is perpendicular to the first surface 1170 and the second surface 1175 of the main body 1110 such that the barricade system 1000 has a larger footprint when viewed from a top view. As the foot 1130 is rotatable, other angle adjustments are anticipated which are less or more than exactly perpendicular relative to the first surface 1170 and the second surface 1175. In a stowed state, the foot 1130 is ideally parallel with the first surface 1170 and the second surface 1175, such that the barricade system 1000 has a smaller footprint when viewed from a top view. This configuration allows for easy transportation, as shown in FIG. 11.

Figure 11:
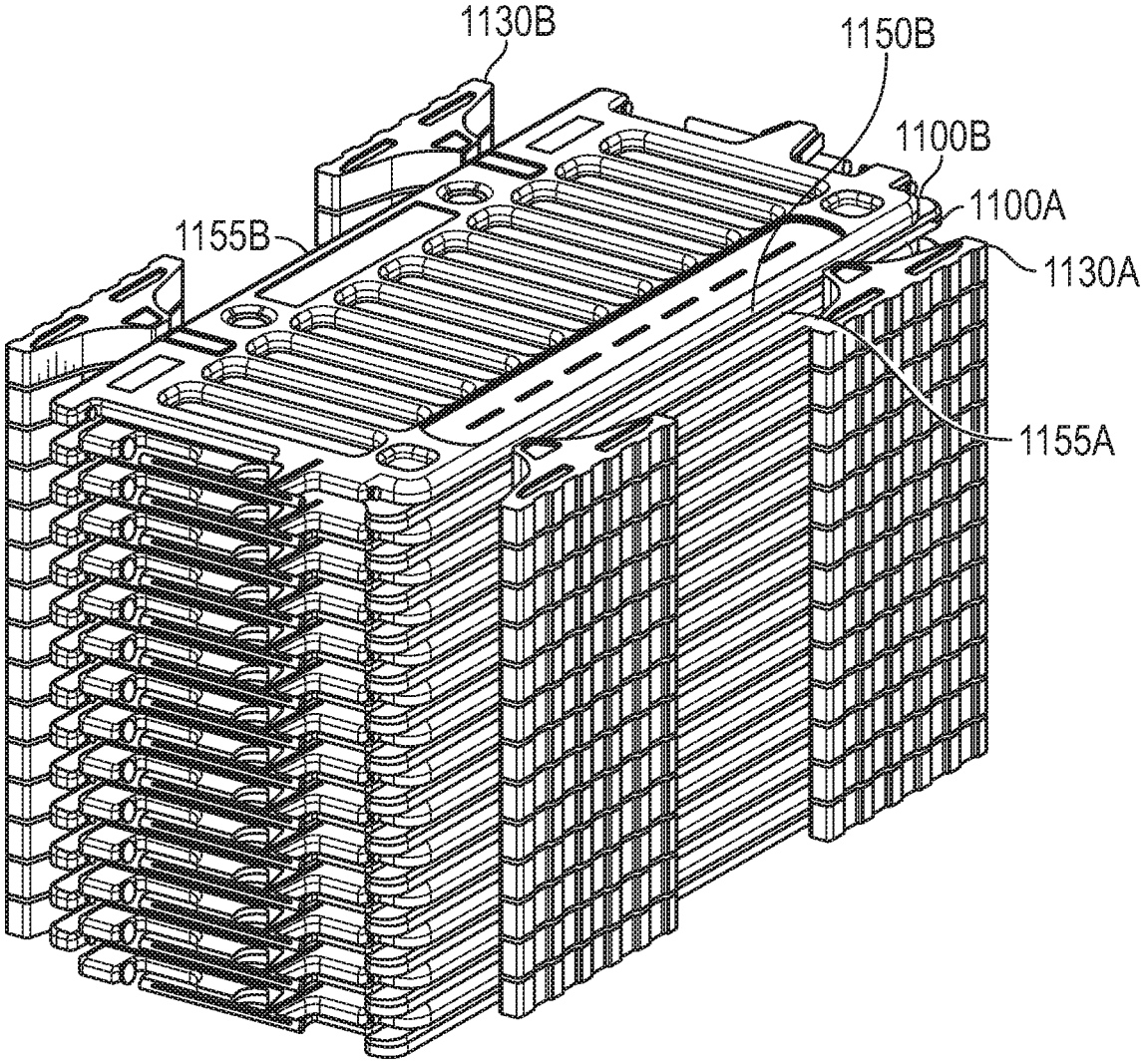
FIG. 11 illustrates an example storage configuration of barricade system 1100 according to certain aspects of the disclosure.

FIG. 11 illustrates an example storage configuration of barricade system 1100 according to certain aspects of the disclosure. Multiple barricade systems 1100 can be horizontally stacked. When the barricade systems 1100, a first barricade system 1100A is stacked on top of a second barricade system 1100B so that the upper side 1150A (not shown) and the lower side 1155A of the first barricade system 1100A align with the lower side 1155B and the upper side 1150B of the second barricade system 1100B. In other words, the foot 1130A of the first barricade system 1100A is disposed on one side of the stacked barricade systems 1100 and the foot 1130B of the second barricade system 1100B is disposed on the opposite side of the stacked barricade systems 1100.

Additionally, some implementations of the disclosed selectively-configurable barricade 100 can include elements, such as gaskets, rubber seals, grommets or other devices or materials, designed to enable selectively-configurable barricade 100 operation in inclement weather, rain, extreme temperatures or other adverse conditions.

In some implementations, the main body 110 can be formed, or blow-molded, from high-density polyethylene, the leg post 120 and foot 130 can be formed of steel and the collar 140 can be formed of acetal (POM). The elements of this disclosure can be formed of any number of polymers, rubbers, foams, metals, metal alloys, ceramics, woods or any other suitable material known to those skilled in the art.

In blow-molded implementations, slugs can be formed by "pinch-offs" in the blow mold used for the main body 110. These slugs can be trimmed away to create the channel 180. Such a process requires no drilling and allows the main body 110 to define a continuous, sealed and waterproof cavity therein. Such a continuous cavity could also hold ballast (such as water or sand) if desired.

While some implementations have been illustrated and described, numerous modifications come to mind without significantly departing from the spirit of the disclosure, and the scope of protection is only limited by the scope of the accompanying claims. Terms such as "top," "bottom,"

"front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. In certain circumstances, multitasking and parallel processing may be advantageous. Moreover, the separation of various system components in the aspects described above should not be understood as requiring such separation in all aspects, and it should be understood that the described program components and systems can generally be integrated together in a single product or packaged into multiple products.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each article of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A barricade system comprising:

a main body including:

an upper side;

a lower side disposed opposite the upper side;

a first lateral side extending between the upper side and the lower side;

a second lateral side extending between the upper side and the lower side, the second lateral side disposed opposite the first lateral side;

a first surface extending between the first lateral side and the second lateral side;

a second surface extending between the first lateral side and the second lateral side, the second surface disposed opposite the first surface; and a channel extending from the lower side toward the upper side, the channel including an opening at the lower side;

a first leg post including a first end and a second end opposite the first end, the first end slidably and rotatably disposed within the channel;

a first foot rigidly connected to the second end of the first leg post; and a collar rigidly connected to a portion of the first leg post disposed within the channel, wherein the channel includes a collar aperture, the collar aperture comprising:

at least one stowed protrusion extending inward for a first distance from a portion of a perimeter of the collar aperture, and at least one stowed detent disposed between the stowed protrusion and the portion of the perimeter of the collar aperture, and wherein the collar rigidly connected to the portion of the first leg post is disposed within the collar aperture of the channel.

2. The barricade system of claim 1, wherein the collar aperture extends from the first surface to the second surface of the main body, and wherein the stowed protrusion and the stowed detent of the collar aperture are disposed on the first surface of the main body.

3. The barricade system of claim 1, wherein the collar comprises:

a first collar opening;

a second collar opening opposite the first collar opening;

a hollow cylindrical portion extending between the first collar opening and the second collar opening, the hollow cylindrical portion receiving the first leg post therethrough;

a rim disposed at the first collar opening, the rim extending radially outward, wherein the rim comprises a circumferential gap between a first rim end and a second rim end, and wherein the barricade system transitions between a deployed state and a stowed state by rotation of the first leg post.

4. The barricade system of claim 3, wherein the first rim end and the second rim end are spaced apart from each other at an angle of 180 degrees.

5. The barricade system of claim 3, wherein the foot has an elongated shape, and wherein the first rim end and the second rim end are parallel with the elongated shaped foot.

6. The barricade system of claim 3, wherein when the barricade system is in the deployed state, an upper surface of the rim abuts a lower portion of the stowed protrusion.

7. The barricade system of claim 6, wherein the upper surface of the rim comprises a collar indent, and wherein when the barricade system is in the deployed state, the collar indent engages with the lower portion of the stowed protrusion.

8. The barricade system of claim 6, wherein the first rim end and the second rim end respectively comprise a first collar locking protrusion and a second collar locking protrusion.

9. The barricade system of claim 8, wherein when the barricade system is in the stowed state, the first collar locking protrusion and the second collar locking protrusion releasably engage the stowed detent of the collar aperture.

10. The barricade system of claim 9, wherein the collar aperture comprises a wall extending from the lower portion of the stowed protrusion to a lower portion of the collar aperture so as to partially close off the collar aperture, wherein when the barricade system transitions from the deployed state to the stowed state by the rotation of the first leg post, the wall prevents the first leg post from further rotating beyond the stowed state by allowing the first rim end to abut the wall.

11. A barricade system comprising:

a main body including:

an upper side;

a lower side disposed opposite the upper side;

a first lateral side extending between the upper side and the lower side;

a second lateral side extending between the upper side and the lower side, the second lateral side disposed opposite the first lateral side;

a first surface extending between the first lateral side and the second lateral side; and a second surface extending between the first lateral side and the second lateral side, the second surface disposed opposite the first surface, wherein the first lateral side comprises an engagement element, wherein the second lateral side comprises an engagement element receptacle, wherein when adjoining the barricade system to an adjacent barricade system, 1) the engagement element receptacle of the barricade system receives an engagement element of the adjacent barricade system or 2) an engagement element receptacle of the adjacent barricade system receives the engagement element of the barricade system, wherein the engagement element receptacle comprises a receptacle port for receiving the engagement element of the adjacent barricade, wherein the receptacle port extends from an upper side to a lower side of the engagement element receptacle, wherein the receptacle port has an elongated shaped opening on the upper side of the engagement, and wherein a longitudinal direction of the elongated shaped opening is perpendicular to the second lateral side.

12. The barricade system of claim 11, wherein the engagement elements extend from the first lateral side for a first distance, and wherein the engagement element comprises a pin extending downward from a lower portion of the engagement element.

13. The barricade system of claim 12, wherein the engagement element receptacle extends from the second lateral side for a second distance, wherein the second lateral side further comprises a boss portion, and wherein the boss portion extends from the second lateral side for a third distance, and wherein the boss portion and the engagement element receptacle are disposed on the second lateral side so that the boss portion is disposed closer to the upper side of the main body than the engagement element receptacle.

14. The barricade system of claim 13, wherein the second distance is larger than the third distance.

15. The barricade system of claim 14, wherein when the barricade system and the adjacent barricade system are engaged, the receptacle port receives the pin of the engagement element of the adjacent barricade system from an upper side of the engagement element receptacle while the engagement element of the adjacent barricade system is sandwiched between the boss portion and the engagement element receptacle.

16. A barricade system comprising:

a main body including:

an upper side;

a lower side disposed opposite the upper side;

a first lateral side extending between the upper side and the lower side;

a second lateral side extending between the upper side and the lower side, the second lateral side disposed opposite the first lateral side;

a first surface extending between the first lateral side and the second lateral side;

a second surface extending between the first lateral side and the second lateral side, the second surface disposed opposite the first surface; and a channel extending from the lower side toward the upper side, the channel including an opening at the lower side;

a first leg post including a first end and a second end opposite the first end, the first end slidably and rotatably disposed within the channel;

a first foot rigidly connected to the second end of the first leg post; and a collar rigidly connected to a portion of the first leg post disposed within the channel, wherein the first lateral side comprises an engagement element, wherein the second lateral side comprises an engagement element receptacle, and wherein when adjoining the barricade system to an adjacent barricade system, 1) the engagement element receptacle of the barricade system receives an engagement element of the adjacent barricade system or 2) an engagement element receptacle of the adjacent barricade system receives the engagement element of the barricade system, wherein the engagement element receptacle comprises a receptacle port for receiving the engagement element of the adjacent barricade, wherein the receptacle port extends from an upper side to a lower side of the engagement element receptacle, wherein the receptacle port has an elongated shaped opening on the upper side of the engagement, and wherein a longitudinal direction of the elongated shaped opening is perpendicular to the second lateral side.

17. The barricade system of claim 16, wherein the main body further comprises:

a sign recess portion on the first surface;

a first main body aperture on a first end of the sign recess portion and a second main body aperture on a second end opposite the first end of the sign recess portion, the first main body aperture and the second main body aperture extending from the first surface to the second surface.

18. The barricade of claim 17, wherein the main body further comprises a first stay tab on a rim of the first main body aperture and a second stay tab on a rim of the second main body aperture, the first stay tab and the second stay tab securing a signage within the sign recess portion.

* * * * *